United States Patent [19]

Hightower

[11] 4,170,095

[45] Oct. 9, 1979

[54] APPARATUS FOR HANDLING CONTAINERS AND THE LIKE OF VARYING DIMENSIONS

[75] Inventor: James R. Hightower, Sanger, Calif.

[73] Assignee: S.W.F. Machinery, Inc., Sanger, Calif.

[21] Appl. No.: 890,078

[22] Filed: Mar. 27, 1978

[51] Int. Cl.[2] ..... B65B 57/02; B65B 7/20

[52] U.S. Cl. ..... 53/75; 53/67; 53/374; 198/456

[58] Field of Search ..... 53/75, 76, 64, 67, 68, 53/69, 70, 374; 198/456

[56] References Cited

U.S. PATENT DOCUMENTS

| | | | |
|---|---|---|---|
| 1,815,571 | 7/1931 | Kimball et al. | 53/374 |
| 2,893,184 | 7/1959 | Lienart | 53/75 |
| 3,187,483 | 6/1965 | Steele et al. | 53/374 |
| 3,237,364 | 3/1966 | Mack | 53/29 |
| 3,426,502 | 2/1969 | Greenberg | 53/75 |
| 3,623,293 | 11/1971 | Boulay | 53/374 |
| 3,821,875 | 7/1974 | Paxton | 53/374 |

*Primary Examiner*—Travis S. McGehee
*Attorney, Agent, or Firm*—Huebner & Worrel

[57] ABSTRACT

An apparatus having a plurality of supports adapted to receive containers with portions of the containers spaced from their respective supports, an assembly mounting the supports in spaced relation to a first path of travel for movement along a second path of travel approaching the first path of travel, and a control system for individually detecting when the portions of the containers reach the first path of travel and thereupon terminating movement of their respective supports along the second path of travel.

21 Claims, 13 Drawing Figures

APPARATUS FOR HANDLING CONTAINERS AND THE LIKE OF VARYING DIMENSIONS

BACKGROUND OF THE INVENTION

1. Field of the Invention

The present invention relates to an apparatus for handling containers and the like of varying dimensions and more particularly to such an apparatus which automatically and dependably adjusts to indiscriminately mixed containers which vary in corresponding dimensions operating to position corresponding portions of the containers for travel along a predetermined path along which work operations are performed with respect to the containers.

2. Description of the Prior Art

An inherent difficulty in assembly line operations is the variation in the sizes, weights, dimensions and the like of the work objects being handled. While this problem is present to some degree in virtually all assembly line operations, it is particularly acute in container handling machines. The standardization of the sizes, weights, dimensions, shapes and the like of containers assists in reducing the problems of adjustment to variations in these respects. However, such standardization is limited by a number of other considerations which serve to prevent elimination of the problem.

For example, in the packing of fruit, vegetables and other fresh food products, the shapes, sizes, weights and perishable nature of the products often controls to a significant degree the characteristics of the containers within which they can be packed. Thus, the packer must tailor his packing operation to handle containers of varying types. Conventional practice calls for the containers to be arranged so that containers of a given type are run followed by adjustment of the equipment to permit containers of another type to be run. Adjustment of the equipment between runs is required to adjust to the dimensions of the next type of container to be run. This is not only a time consuming and tedious operation resulting in significant down time, but often requires trial runs to determine if satisfactory adjustment has been achieved. Such trial runs frequently damage the containers, food products and, in some instances, the equipment. These difficulties are compounded in container sealing machines where adhesive must be applied to certain portions of each container. The tolerances involved in such operations are extremely close. Thus, in some instances variations in containers of the same type prevent satisfactory operation of the machine, or, at very least, require precise adjustment of the machines to accommodate such variations. In any event, the variation in dimensions with conventional container handling equipment requires the implementation of practices which significantly interfere with an otherwise efficient operation.

Therefore, it has long been known that it would be desirable to have an apparatus for handling containers and the like of varying dimensions which are randomly conveyed therethrough; which automatically and virtually instantaneously adjusts to the size of each container in a given dimension to position the portion of the container on which the work operation is to be performed at precisely the desired location; and which requires no manual adjustment or monitoring of the machine to insure a fully dependable and efficient operation.

SUMMARY OF THE INVENTION

Therefore, it is an object of the present invention to provide an improved apparatus for handling containers and the like.

Another object is to provide such an apparatus which can receive and perform predetermined work operations with respect to containers which are of varying dimensions and are randomly fed through the apparatus.

Another object is to provide such an apparatus which immediately self-adjusts to the size of each container in a given dimension without requiring shutdown and manual readjustment of the apparatus.

Another object is to provide such an apparatus which defines a path of travel along which work operations are performed and which automatically positions corresponding portions of successive containers in the path of travel for the performance of the work operations with respect thereto.

Another object is to provide such an apparatus which operates to seal predetermined portions of successive containers where the distance between the bottom of a given container and the portions to be sealed varies to a considerable degree from container to container.

Another object is to provide such an apparatus in which the weight of each container and its contents operate in cooperation with the components of the apparatus to maintain a selected adjusted position for travel through the machine.

Another object is to provide such an apparatus which is adjustable in advance of operation to handle containers of a range of weights and sizes most suited to the needs of the operator.

Another object is to provide such an apparatus which does not require the use of pneumatic systems, but rather operates through the use of mechanical components having a simplicity of operation so as to insure a dependability of use.

Another object is to provide such an apparatus which employs a compression station in which the portions of the apparatus exerting the compressive force are motivated with and at the speed of the portions of the container under compression.

Further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

Figure 1:
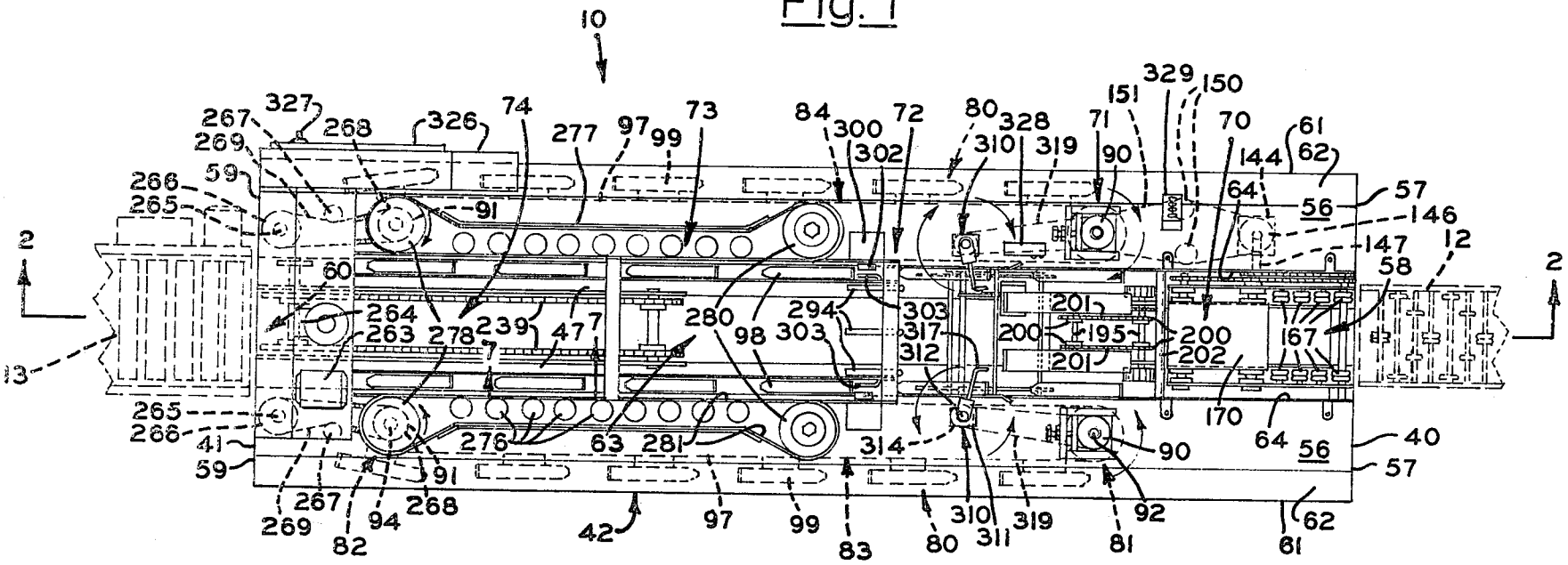
FIG. 1 is a top plan view of the apparatus of the present invention.

Referring more particularly to the drawings, the apparatus of the present invention is generally indicated by the numeral 10 in FIG. 1. The apparatus is supported on a horizontal floor surface 11. A feed conveyor of any suitable type is indicated at 12 disposed in position for feeding containers successively to the apparatus. A discharge conveyor is indicated at 13 for receiving successive containers from the apparatus.

It will become apparent that the apparatus 10 can be employed in conjunction with the performance of a variety of work operations not only on containers, but also other work objects. However, the apparatus has particular utility in the sealing of containers for the reasons previously noted. Thus, the preferred embodiment herein described is an apparatus for sealing containers such as indicated at 20. The container has a bottom panel 21 with upstanding end panels 22 having upper edges 23. The end panels are joined edgewardly by a pair of side panels 24 which individually mount downwardly foldable top flapes 25. Each top flap has endwardly extending side flanges 26. Each side flange has an upper surface 27 and lower surface 28. For illustrative convenience, the container 20 is indicated as having a height 29 which is the distance between the bottom panel 21 to the upper edge 23 of each end panel 22.

The apparatus 10 has a forward end 40 in juxtaposition to the feed conveyor 12 and an opposite rearward end 41 in juxtaposition to the discharge conveyor 13. The apparatus has a main frame 42 with eight legs 43. The legs mount a horizontal bed 44 extending between the forward and rearward ends 40 and 41 respectively of the apparatus. The horizontal bed includes a pair of main lower channel members 45 secured, as by welding, on the legs and extending in spaced, substantially parallel relation from the foward to the rearward end of the main frame with the channels defined thereby disposed in upwardly facing relation. The channel members 45 are interconnected by four cross channel members 46 mounted, as by welding, on the channel members 45 in spaced, substantially parallel relation. Each pair of adjacent channel members 46 are interconnected by inverted central channel members 47 extending longitudinally of the horizontal bed.

A plurality of vertical frame members 55 are secured as by welding on the lower channel members 45 and extend upwardly therefrom as necessary to support the various operative components of the apparatus 10 hereinafter to be described. A pair of inverted main upper channel members 56 are affixed on the upper portions of the vertical frame members 55. The frame members 55 extend longitudinally of the apparatus parallel to and in vertical alignment with the lower channel members. A pair of front end fairings 57 are removably mounted on the vertical frame members 55 at the forward end 40 of the apparatus and are spaced from each other to define a passage 58 therebetween. A pair of rear end fairings 59 are removably mounted on the vertical frame members at the rearward end 41 of the apparatus and define a passage 60 therebetween. A pair of side fairings 61 are removably fastened on the lower and upper channel members 45 and 56 on opposite sides of the apparatus. The side fairings have upper horizontal portions 62 which individually extend to and are removably fastened on the upper channel members 56. The upper channel members and side fairings define a passage 63 extending therebetween interconnecting the passages 58 and 60. A guide plate assembly 64 is secured on each channel member 56 adjacent to the forward end 40 of the apparatus. The guide plate assemblies extend into the passage 63 to guide and insure proper orientation of containers passing therebetween.

For purposes of illustrative convenience, the apparatus 10 can be identified as having a receiving station 70 immediately adjacent to the forward end 40 of the apparatus. An adjusting station 71 is provided immediately adjacent to the receiving station. The apparatus has a folding and gluing station 72 on the opposite side of the adjusting station from the receiving station. A compression station 73 extends from the folding and gluing station toward the rearward end 41 of the apparatus. A discharge station 74 extends from approximately midway through the folding and gluing station, as can best be visualized in FIG. 2, to the rearward end 41 of the apparatus.

The apparatus has a main conveyor assembly 80 mounted on the horizontal bed 44 of the main frame 42 extending from a forward portion 81 immediately adjacent to the receiving station 70 of the apparatus along the main frame to a position adjacent to the rearward end 41 of the apparatus midway through the discharge station 74. The conveyor assembly 80 is composed of a conveyor 83 disposed to the left of passage 63, as viewed in FIG. 3, and a conveyor 84 disposed to the right of passage 63 as viewed in FIG. 3. The conveyors are of substantially identical construction and, for illustrative convenience, are described simultaneously herein.

Each conveyor 83 and 84 is mounted on and extends vertically between vertically aligned lower and upper channel members 45 and 56 of the main frame 42. Each conveyor has a pair of forward bearings 90 individually mounted on the lower and upper channel members 45 and 56 respectively and aligned to define an axis of rotation right angularly related to the channel members and disposed in substantially vertical relation. Similarly, each conveyor has a pair of rearward bearings 91 individually mounted on the lower and upper channel members 45 and 56 respectively and aligned to define a substantially vertical axis of rotation. A forward shaft 92 is mounted in the forward bearings 90 of each conveyor for rotational movement and has opposite ends 93 extending outwardly through the respective channel members 45 and 56. A rearward shaft 94 is mounted for rotational movement in the rearward bearings 91 of each conveyor. Each rearward shaft has opposite ends 95 extending through and outwardly of the channel members 45 and 56. The forward and rearward shafts individually mount a pair of sprockets 96 for rotational movement therewith in spaced relation. The sprockets of each shaft are preferably received within their respective channel member. Each conveyor has a pair of endless chains 97 which are individually mounted on and extended about corresponding sprockets 96 of the shafts for rotational movement by the shafts along substantially horizontal paths within their respective channel member. Thus, the chains of each conveyor have inner runs 98 which move adjacent to the passage 63 from right to left as viewed in FIG. 1 and outer runs 99 remote from the passage 63 which move from left to right, as viewed in FIG. 1.

Figure 2:
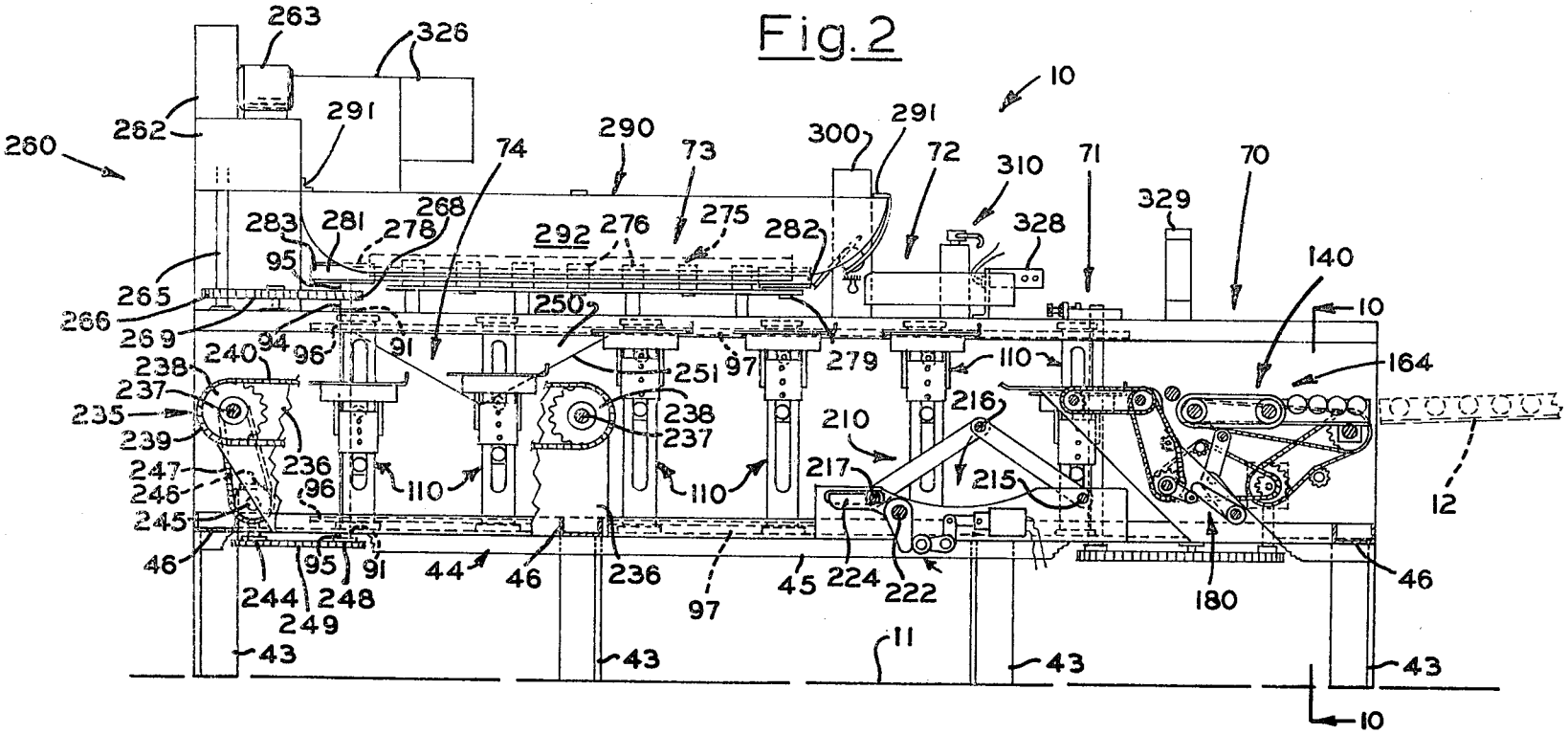
FIG. 2 is a fragmentary, longitudinal vertical section taken on line 2—2 in FIG. 1.

The conveyors 83 and 84 of the main conveyor assembly 80 each mount a plurality of container support assemblies 110 for movement with the pairs of chains thereof along the inner and outer runs 98 and 99 respectively. The support assemblies are disposed in equally spaced relation along the runs of the chains. Each support assembly has a vertical member plate 111 having opposite ends fastened individually on the chains 97 of each conveyor so as to interconnect the chains at corresponding positions, as shown in FIG. 2. The plates thus extend in substantially right angular relation between the chains of each pair for movement therewith. Each plate has a vertical slot 112 extending therethrough. Slide pads 113 are individually affixed on the opposite ends of each vertical plate for sliding engagement with their respective channel members 45 and 56. The slide pads are preferably constructed of a friction reducing material such as ultra high molecular polyethylene plastic or the like.

A slide assembly 114 is mounted for vertical sliding movement on the vertical plate 111 of each support assembly 110. Each slide assembly includes a traveler 115 received for sliding movement within the slot 112 of the plate. The traveler is of a very slightly greater thickness than the vertical plate 111. The traveler mounts a receiving roller 116 on the lower end of the traveler extending to the left as viewed in FIG. 8. Similarly, a discharge roller 117 is mounted at the upper end of the traveler and extends to the right as viewed in FIG. 8. Each slide assembly has a first plate 118 having a pair of recesses 119 disposed in spaced relation therein. Each slide assembly has a second plate 120 having a pair of recesses 121 therein corresponding to the recesses 119 of the first plate. The second plate 120 also has a pair of spring holes 122 extended therethrough into individual communication with the recesses 121 substantially centrally thereof. Slide pads 123 are received in the recesses 119 and 121 of the plates 118 and 120 and extended therefrom for engagement with the vertical plate 111 on opposite sides of the traveler. The slide pads are preferably constructed of sintered bronze impregnated with a lubricant or a similar material which permits controlled sliding movement of the slide assembly along the vertical plate, as will hereinafter be described. The first and second plates 118 and 120 are secured on the traveler 115 by three bolt and nut assemblies 124 for movement of the plates with the traveler. The slide pads are thus captured between their respective plate and the vertical plate 111 and in engagement with the vertical plate to facilitate sliding movement of the slide assembly therealong. A pair of studs 125 are borne by the traveler 115 and extend through the second plate 120 at substantially right angles to the vertical plate 111. A spring plate 126, having holes 127 extending therethrough, is slidably received on the studs with the studs individually extending through the holes 127. A pair of springs 128 are borne by the spring plate and extend through the spring holes 122 of the second plate and against the slide pad 123 on opposite sides of the traveler. Lock nuts 129 are tightened on the studs to capture the spring plate thereon. It will be seen that the nuts can be adjusted toward or from the vertical plate to increase or alternatively decrease pressure on the slide pads 123 of the second plate and thus correspondingly the amount of force required to move the slide assembly along the vertical plate.

Figure 8:
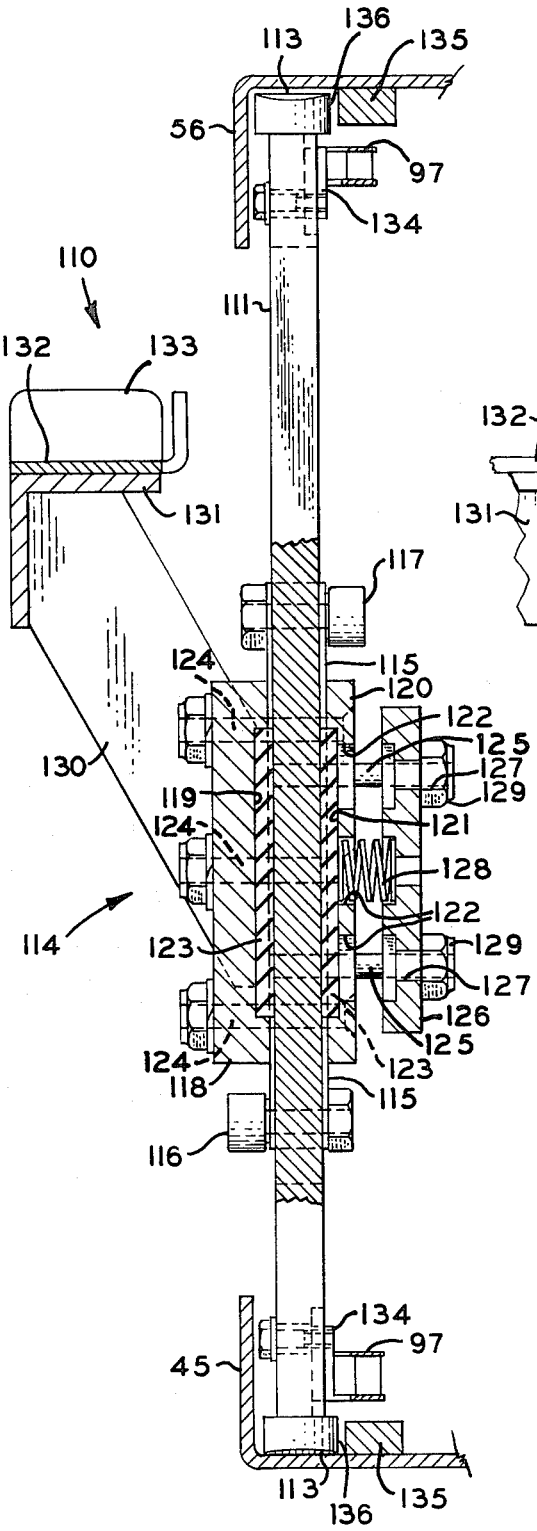
FIG. 8 is a vertical section taken on line 8—8 in FIG. 7.
Figure 7:
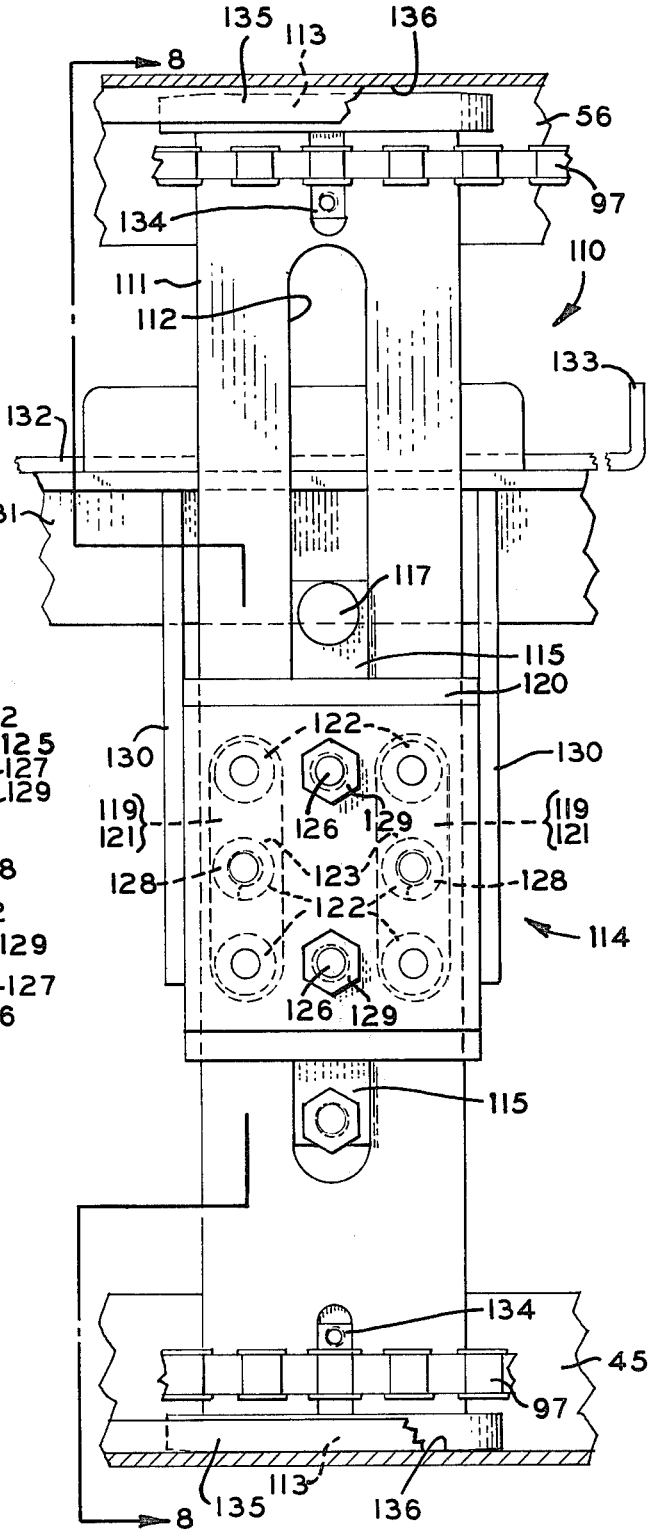
FIG. 7 is a fragmentary front elevation of one of the container support assemblies of the apparatus taken on line 7—7 in FIG. 1.

A pair of arms 130 are mounted on the first plate 118 of each slide assembly 114 and extend upwardly and outwardly therefrom. A mounting plate 131 is borne by the arms extending in substantially horizontal relation therebetween. A support 132 is fastened on the mounting plate 131 and has an upwardly extending back lip 133 with respect to the direction of travel. Thus, as can best be seen in FIG. 1, corresponding support assemblies 110 of the conveyors 83 and 84 are mounted for movement along their respective inner runs 98 from right to left as viewed in FIGS. 1 and 2 aligned transversely of the apparatus. During such travel, the back lips 133 of the supports 132 are disposed in trailing relation to the direction of travel. As best shown in FIGS. 7 and 8, each support assembly 110 is connected to the chains 97 of its respective conveyor 83 or 84 by a pair of attachment lugs 134. Guides 135 are mounted on and within the channel members 45 and 56 to define endless tracks 136 within which the slide pads 113 move when following the inner and outer runs 98 and 99 respectively of the conveyors. A suitable lubricant can be applied to these tracks if desired.

A container positioning mechanism 140 is mounted in the receiving station 70 of the apparatus 10 with portions thereof extending into the adjusting station 71 thereof. The mechanism includes a pair of arms 141 individually mounted on the central channel members 47 and extending forwardly and upwardly to positions between the forward shafts 92 of the conveyors 83 and 84. A pair of container supports 142 are mounted in juxtaposition on the arms 141 defining a substantially horizontal plane and having forward lips 143 which extend forwardly and upwardly therefrom.

Figure 3:
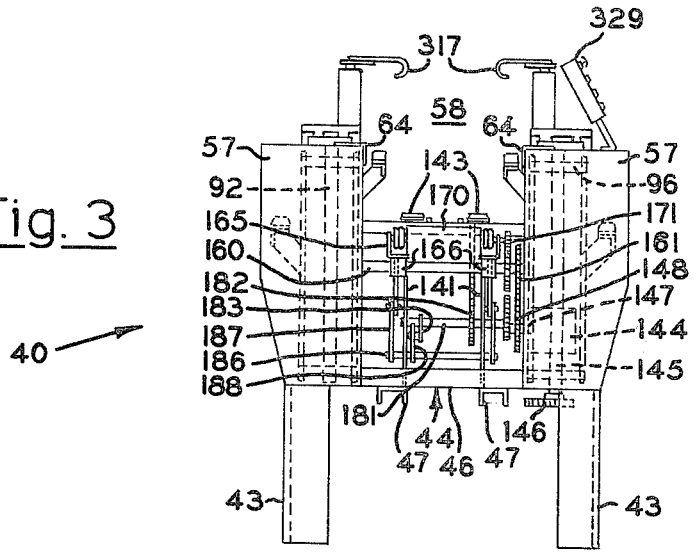
FIG. 3 is a front elevation of the apparatus.

A right angle gearbox 144 is mounted on the lower channel member 45 on the right as viewed in FIG. 3. The right angle gearbox has an input shaft 145 which extends downwardly through the channel member and mounts a sprocket 146 on the lower end thereof. The right angle gearbox has an output shaft 147 extending horizontally therefrom through the adjacent vertical frame member 55 to a position just inwardly of the passage 63. A pair of sprockets 148 are mounted on the output shaft within the passage 63. A sprocket 149 is mounted on the opposite end 93 of the forward shaft 92 of conveyor 84. A pair of idler sprockets 150 are mounted on the channel member 45 between the sprockets 146 and 149 and disposed in a plane defined thereby. A drive chain 151 is extended about the sprockets 146, 149 and 150 in driving relation to the right angle gearbox 144. Thus, it will be seen that the output shaft 147 is driven in rotational movement by movement of the conveyor 84, as will hereinafter be described.

A transverse shaft 160 is mounted on the vertical frame members 55 on opposite sides of the passage 58 and extends between the frame members 55, as best shown in FIG. 3. A pair of drive transfer sprockets 161 are mounted for rotational movement as a unit about the shaft 160 adjacent to the vertical frame member 55 on the right as viewed in FIG. 3. An idler sprocket 162 is mounted in a predetermined position on the vertical frame member 55 in vertical alignment with one of the sprockets 161. A drive chain 163 is extended about one of the pair of sprockets 148 of the output shaft 147 of the right angle gearbox 144 and one of the drive transfer sprockets 161 being engaged also with the idler sprocket 162, as best shown in FIG. 2.

An indexing conveyor assembly 164 is pivotally mounted on the transverse shaft 160. The indexing conveyor assembly includes a pair of spaced substantially parallel angle iron members 165 which are individually pivotally mounted at common ends thereof on the transverse shaft by a pair of pivot mounts 166. Each of the angle iron members mounts a plurality of idler wheels 167 thereof in proximity to the transverse shaft, as best shown in FIG. 2. A pair of shafts 168 are mounted on and interconnect the angle iron members in spaced relation remote from the transverse shaft 160. Each of the shafts mounts a roller 169 thereon for rotational movement. A belt 170 is extended rotationally about the rollers. A sprocket 171 is affixed on the shaft 168 farthest from shaft 160. A drive chain 172 extends about the sprocket 171 and about the other of the drive transfer sprockets 161. Thus, it will be seen that operation of the conveyor 84 drives the belt 170 in a counterclockwise direction as viewed in FIG. 2 about the rollers 169. Similarly, it will be seen that the indexing conveyor assembly 164 is free to pivot about the transverse shaft 160. A stop 173 is borne by the vertical frame member 55 and is gravitationally engaged by the indexing conveyor assembly 164 to prevent its pivoting farther in a counterclockwise direction than the position, shown in FIG. 2.

The positioning mechanism 140 has an indexing mechanism 180. The indexing mechanism has a lower shaft 181 mounted on and extending rotationally between the arms 141. A pair of sprockets 182 are individually mounted on the lower shaft on opposite sides of the arm 141 on the right as viewed in FIG. 3. A cam member 183 is mounted on the lower shaft for rotational movement therewith. An idler sprocket 184 is secured on the vertical frame member 55 on the right as viewed in FIG. 3. A drive chain 185 is extended about the available sprocket 148 on the output shaft 147 of the gearbox 144, the idler sprocket 184 and the sprocket 182 outwardly of the arm 141. Thus, it will be seen that rotation of the output shaft 147 of the gearbox 144 causes the lower shaft 181 of the indexing mechanism 180 to be rotated. Accordingly, the cam member 183 is rotated in a counterclockwise direction with the shaft as viewed in FIG. 2.

The indexing mechanism 180 further includes a pivot shaft 186 which is mounted on and extends rotationally between the arms 141. A pair of linkages 187 interconnect the shaft 186 and the angle iron members 165 of the indexing conveyor assembly 164. A lever arm 188 is secured on the shaft 186 between the arms 141 for movement with shaft 186. Thus, during operation of the apparatus the cam member 183, in rotation with the lower shaft 181, strikes the lever arm 188 to extend the linkages 187 thereby pivoting the indexing conveyor assembly 164 from the "at rest" position shown in FIG. 2 against the stop 173 to a position slightly elevated therefrom in a clockwise direction.

A pair of shafts 195 are rotationally mounted on and extend between the arms 141 adjacent to the supports 142. The shaft 195 nearest the indexing conveyor assembly 164 mounts a pair of feeding wheels 196 on the opposite ends thereof. The feeding wheels extend upwardly to points slightly higher than the container supports 142. A sprocket 197 is borne by the same shaft 195. An idler sprocket 198 is mounted on the arm in the same plane as sprocket 197. A drive chain 199 is operatively extended about the available sprocket 182 of the lower shaft 181, idler sprocket 198 and sprocket 197 of shaft 195. Thus, rotation of the lower shaft 181 causes rotation of the shaft 195 adjacent to the indexing conveyor assembly 164. A pair of sprockets 200 are individually mounted on each of the shafts 195. A pair of chains 201 are individually extended around corresponding sprockets 200 of the shafts 195 as shown in FIG. 1. A stop bar 202 is mounted on the vertical frame members 55 which are adjacent to the forward end 40 of the apparatus 10. The stop bar 202 extends between the indexing conveyor assembly 164 and the feeding wheels 196 extending slightly thereabove as best shown in FIG. 2. Thus, when the indexing conveyor assembly 164 is in the "at rest" position shown in FIG. 2, a container transported therealong stops against the stop bar 202. When the conveyor assembly 164 is elevated therefrom by the indexing mechanism, the container is transported over the stop bar by the conveyor assembly 164 and is engaged by the feeding wheels 196 and chains 201 so as to feed the container onto the supports 142.

The apparatus 10 has an adjusting mechanism 210 mounted in the adjusting station 71. The adjusting mechanism has a pair of mounting plates 211 which are individually mounted, as by welding, on the lower channel members 45 of the horizontal bed 44 in upright relation. The mounting plates have corresponding slots 212 extending substantially horizontally in predetermined positions remote from the indexing conveyor assembly 164. Each mounting plate mounts an arm assembly or pair of arms 213 which define a first sliding means or cam way 214. Each pair of arms is mounted adjacent to the indexing conveyor assembly on its respective plate by a pivot shaft 215 pivotally interconnecting corresponding ends of the arms of each pair nearest the positioning mechanism 140 and the mounting plates 211. The arms of each pair are interconnected by a pivot shaft 216 which extends between the pairs of arms. The remote ends of the corresponding arms of each pair remote from the indexing conveyor assembly are interconnected by a shaft 217 which extends through slots 212 of the mounting plates 211. Thus, the pairs of arms are mounted on their mounting plates for movement from the cam or raised position shown in FIG. 2 to a position collapsed downwardly therefrom as permitted by the shaft 217 within the slots 212.

Figure 9:
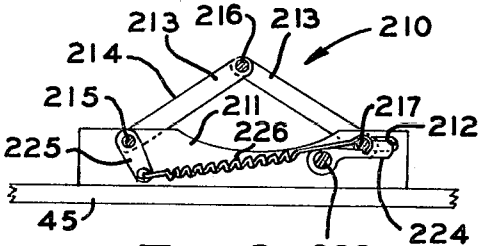
FIG. 9 is a fragmentary, longitudinal vertical section of the adjusting mechanism of the apparatus showing the portion thereof opposite to that shown in FIG. 2.
Figures 5, 6:
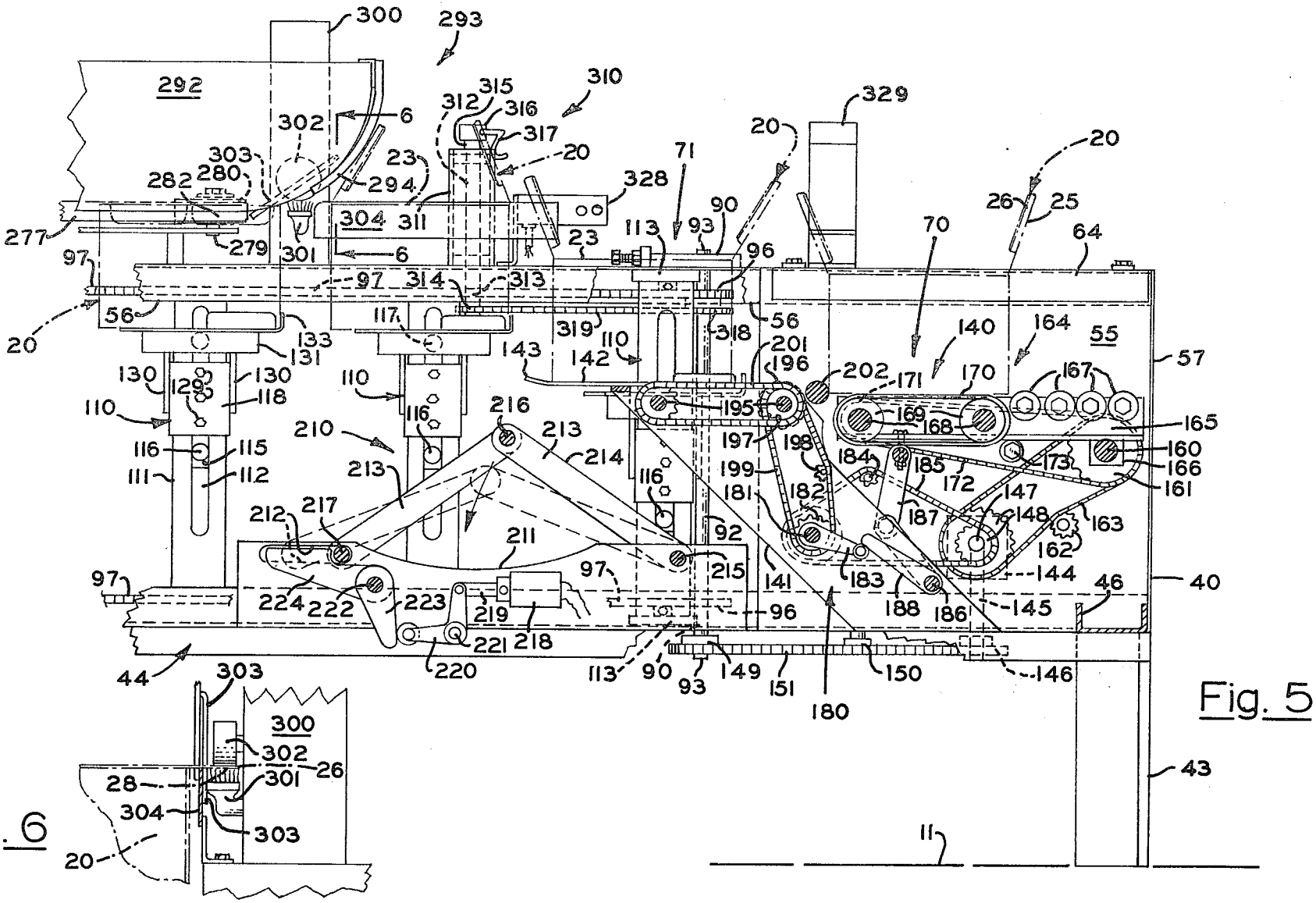
FIG. 5 is a somewhat enlarged, fragmentary, longitudinal vertical section of the forward portion of the apparatus taken from a position corresponding to that in FIG. 2.
FIG. 6 is a transverse vertical section taken on line 6—6 in FIG. 5.

A solenoid 218 is mounted on the mounting plate 211 closest to conveyor 84. The solenoid mounts a plunger or shaft 219 extended therefrom for extension and contraction by the solenoid in the conventional manner. A bell crank 220 is mounted on the mounting plate in a predetermined position by a pivotal connection 221 and is connected, as shown in FIG. 5, to the shaft 219 of the solenoid for pivotal movement thereby. A shaft 222 is mounted for pivotal movement on and extending between the mounting plates 211 parallel to the shaft 217. A lever 223 is affixed on the shaft 222 for movement therewith and engagement, in one operative position, by the bell crank 220 as shown in FIG. 5. A pair of latches 224, serving as a latch mechanism are borne by the shaft 222 for movement therewith from positions engaging the shaft 217, as shown in FIGS. 5 and 9 to positions downwardly released therefrom. Thus, it will be seen that retraction of the shaft 219 by the solenoid 218 causes the latches to be brought upwardly into engagement with the shaft 217 to lock the cam ways 214 in the raised positions. Conversely, extension of the shaft 219 releases the latches from the shaft 217. A bell crank 225 is mounted on shaft 215 extending downwardly therefrom adjacent to conveyor 83. A tension spring 226 interconnects the bell crank and shaft 217, as shown in FIG. 9, resiliently to retain the pairs of arms and the cam ways 214 defined thereby in the position shown in FIG. 2 even when the latch has been released. However, the pairs of arms can be collapsed downwardly against tension of the spring if sufficient force is exerted on the cam ways 214.

Figure 4:
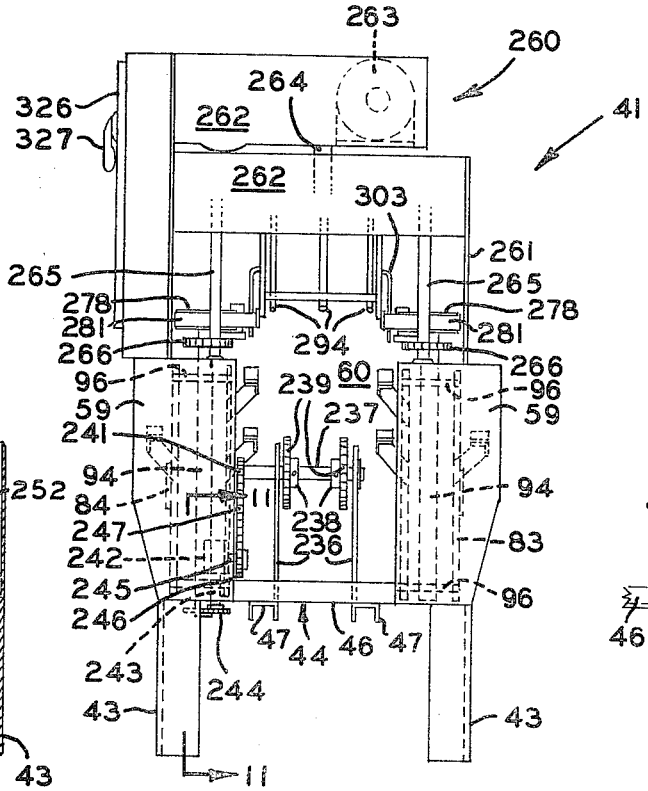
FIG. 4 is a rear elevation of the apparatus.

A discharge conveyor assembly 235 is mounted in the discharge station 74 of the apparatus 10. The conveyor assembly 235 includes a pair of mounting plates 236 individually secured as by welding on the central channel members 47, as best shown in FIG. 4. A pair of shafts 237 are individually rotationally mounted in substantially parallel relation on the mounting plates 236 adjacent to the upper ends thereof for rotational movement about axes substantially right angularly related to the passage 63 of the apparatus. A pair of sprockets 238 are individually secured on each of the shafts 237 with corresponding sprockets of each pair aligned longitudinally of the apparatus. A pair of chains 239 are extended about corresponding sprockets of each pair extending longitudinally of the discharge station. The chains have upper runs 240 which are disposed above the upper edges of the mounting plates 236 and are adapted to be transported, as will hereinafter be described, from right to left as viewed in FIG. 2.

A sprocket 241 is mounted on the shaft 237 nearest the rearward end 41 of the apparatus 10. The sprocket 241 is mounted on the shaft 237 on the left as viewed in FIG. 4. A right angle gearbox 242 is affixed on the vertical frame member 55 on the left as viewed in FIG. 4. The gearbox has an input shaft 243 mounting a sprocket 244 and an output shaft 245 mounting a sprocket 246. A drive chain 247 extends operationally about sprocket 246 and about sprockets 241 of shaft 237. A sprocket 248 is mounted on the opposite end 95 of the rearward shaft 94 on the left as viewed in FIG. 4. A drive chain 249 operably interconnects sprocket 248 and sprocket 244 of the input shaft 243. Thus, it will be seen that movement of the conveyors 83 and 84 of the main conveyor assembly 80 drives the discharge conveyor assembly 235 through the right angle gearbox 242 to transport the upper runs 240 of the pair of chains 239 toward the rearward end 41 of the apparatus 10. A pair of cam plates 250 are individually mounted on the upper channel members 56 in the discharge station 74. The cam plates individually define corresponding second sliding means, cam edges or ways 251 extending rearwardly and downwardly from their respective channel members in positions for engagement by the discharge rollers 117 of the container support assemblies. The right angle gearbox 242 also mounts a shaft 252 driven with output shaft 245 but extending in the opposite direction therefrom. The shaft mounts a cam wheel 253 for rotational movement with the shaft 252.

The apparatus 10 has a drive assembly generally indicated at 260. The drive assembly includes a frame 261 mounted in upright relation on the upper channel members 56 adjacent to the rearward end 41 of the apparatus. A pair of gearboxes 262 are mounted on the frame. A drive motor 263 is mounted on the gearboxes in driving engagement with the upper gearbox 262. A main drive train 264 extends from the drive motor through the upper gearbox and into the lower gearbox. A pair of drive shafts 265 are mounted on the lower gearbox for rotation about substantially vertical axes of rotation. The drive shafts 265 are connected in driven relation to the main drive train 264 within the lower gearbox so that they are rotated in opposite complimentary directions. The drive shafts 265 extend beneath the lower gearbox to lower end portions on which sprockets 266 are individually mounted. It will be understood that the interconnection of the gearboxes 262, main drive train 264 and drive shafts 265 is such that the drive motor 263 drives the shafts 265 at the desired speeds of rotation. The drive shaft 265 above, as viewed in FIG. 1, is driven in a clockwise direction and the drive shaft 265 below, as viewed in FIG. 1, is driven in a counterclockwise direction.

An idler sprocket 267 is mounted on the upper channel member 56 on each side of the apparatus at corresponding locations, as shown in FIG. 1. A sprocket 268 is mounted on the opposite upper end 95 of each shaft 94 for rotation therewith. A drive chain 269 operatively extends about and thus links the sprocket 266, idler sprocket 267 and sprocket 268 on each side of the apparatus, as best shown in FIG. 1. Thus, it will be seen that operation of the motor 263 operates to drive the conveyors 83 and 84 of the conveyor assembly 80 in rotational movement so that the inner runs 98 thereof are transported from right to left as viewed in FIG. 1.

A compression assembly 275 is mounted on each upper channel member 56 in the compression station 73 of the apparatus 10. Each compression assembly has a plurality of roller assemblies 276 mounted for individual rotational movement about substantially vertical axes, as best shown in FIG. 1. The roller assemblies on opposite sides of the apparatus have portions extending toward each other to positions slightly inwardly of vertical alignment with the lateral bounds of the passage 63. The distance between the inward extensions of corresponding roller assemblies on opposite sides of the apparatus is substantially the same as distance between the end panels 22 of the container 20 so that the desired compressive force can be applied, as will hereinafter be described. A guide plate 277 is fastened on each upper channel member substantially parallel to the roller assemblies thereof and preferably mounted so as to be adjustable toward and from the roller assemblies. Pulleys 278 are individually mounted on the upper opposite ends 95 of the rearward shafts 94, as best shown in FIG. 2. A pair of pulley mounts 279 are individually borne by each compression assembly on the opposite side of the roller assemblies 276 from the pulley 278 of each compression assembly. A pulley 280 is mounted for rotational movement on each pulley mount 279. Belts 281 are individually operably extended about the pulleys 278 and 280 and about the roller assemblies and guide plates therebetween on opposite sides of the passage 63, as best shown in FIG. 1. The compression assemblies define an entrance 282 and an opposite exit 283 therebetween. Thus, it will be seen that the compression assemblies 275 are driven through the rearward shafts 94 to transport the belts 281 thereof from right to left as viewed in FIG. 1 along the roller assemblies for compression of the side flanges 26 of each container 20 against the end panels 22 thereof during operation of the apparatus.

A top flap folding assembly 290 is mounted on the apparatus 10. The folding assembly has a support frame 291 secured on the upper channel members 56 above the folding and gluing station 72. A guide housing 292 is affixed on the frame extending longitudinally of the apparatus above the folding and gluing station and passage 63 as shown in FIG. 2. The housing has an entrance end portion 293 mounting a plurality of guide bars 294 curving downwardly from the guide housing and defining a surface against which the forwardmost top flap 25 of each container 20 is folded during transport of the containers through the apparatus.

The pair of adhesive dispensing units 300 are individually mounted on the channel members 56 on opposite sides of the passage 63. Each of the units mounts an upward facing nozzle 301 through which adhesive is dispensed from the unit. The nozzle extends into the passage 63 at a predetermined elevation. The metering wheel 302 is mounted on each of the units immediately above its respective nozzle and is adapted to be engaged by the side flanges 26 of each container 20 passing through the folding and gluing station 72. Such engagement rotates the wheel which operates the unit to pump adhesive through the nozzle and onto the lower surface 28 of each side flange during such movement. A folding bar 303 is mounted on each dispensing unit and is angled downwardly and toward the entrance 282 of the compression assembly 275 for folding the side flanges 26, to which adhesive has been applied, of each successive container downwardly against the end panels 22 of the container for introduction to the entrance of the compression assembly. A flange guide plate 304 is mounted on each channel member 56 extending longitudinally thereof immediately ahead of the dispensing unit and the folding assembly 290, as best shown in FIGS. 5 and 6.

A pair of trailing top flap folding assemblies 310 are mounted on the upper channel members 56 on opposite sides of the passage 63 in predetermined positions, as best shown in FIGS. 1 and 2, in adjacent spaced relation to the entrance end portion 293 of the top flap folding assembly 290. Each of the assemblies has a mount 311 within which a shaft 312 is mounted for rotational movement about a substantially vertical axis. Each shaft 312 has a lower end 313 mounting a sprocket 314. Each shaft 312 has an upper end 315 having a mount 316 affixed thereon for rotational movement therewith. A folding rod 317 is secured on the mount in substantially right angular relation to the shaft thereof. A sprocket 318 is borne by each forward shaft 92 in the same plane as sprocket 314. A drive chain 319 is extended about and operatively interconnects each sprocket 318 and its respective adjacent sprocket 314. Thus, the folding rods are rotated in the complimentary paths of travel shown in FIG. 1, during movement of the conveyor 83 and 84, by the forward shafts 92. Thus, it will be seen that during passage of a container 20 through the apparatus, the folding rods 317 are rotated into engagement with the trailing top flap 25 of each container to fold them downwardly prior to introduction of the container into the entrance end portion 293 of the top flap folding assembly 290. As previously noted, the guide bars 294 of the folding assembly 290 fold the leading top flap downwardly so that the top flaps are both folded in horizontal covering relation to the container. It will also be seen that such a folding operation operates to extend the side flanges 26 laterally of the container for movement over their respective flange guide plates 304 and between their respective nozzles 301 and metering wheels 302 of the dispensing units 300.

Figure 12:
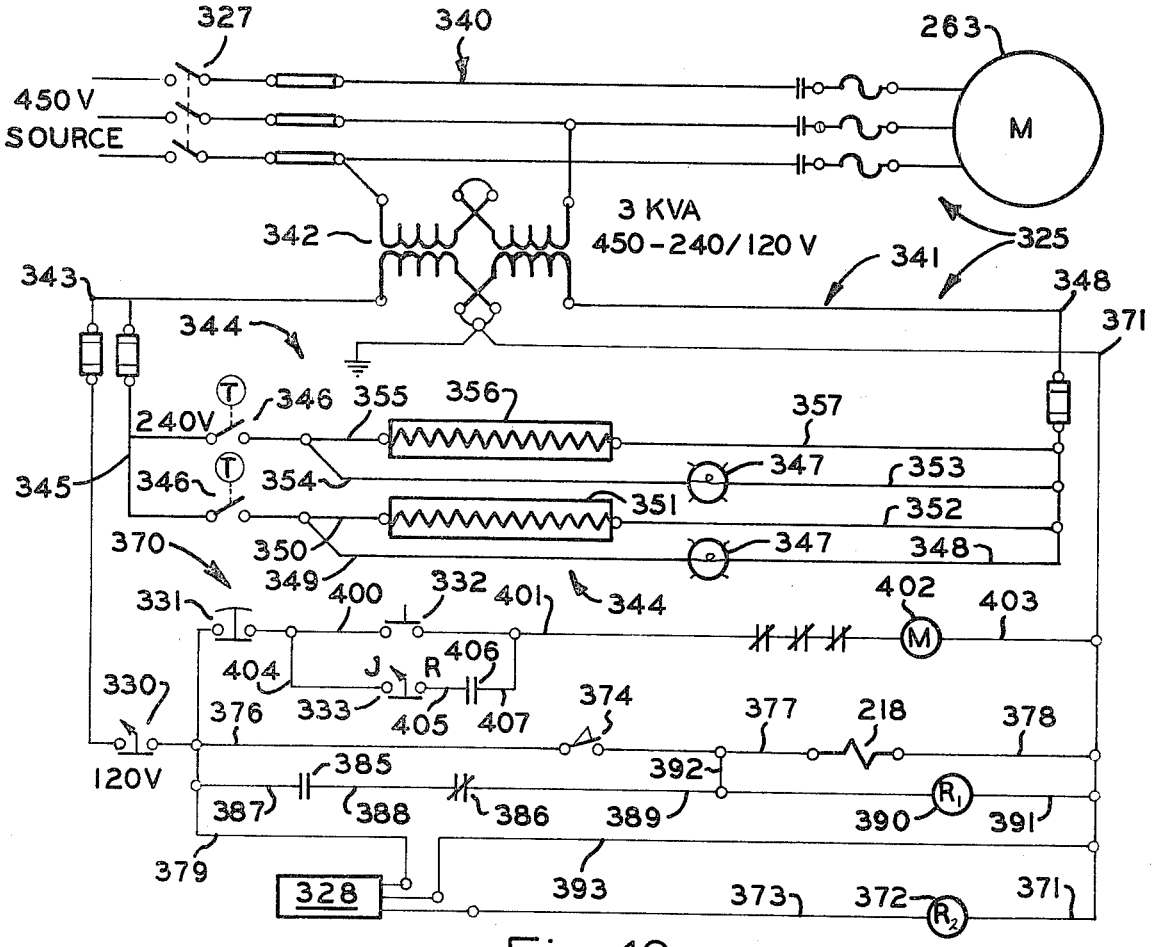
FIG. 12 is a schematic diagram of the control system of the apparatus.
Figure 13:
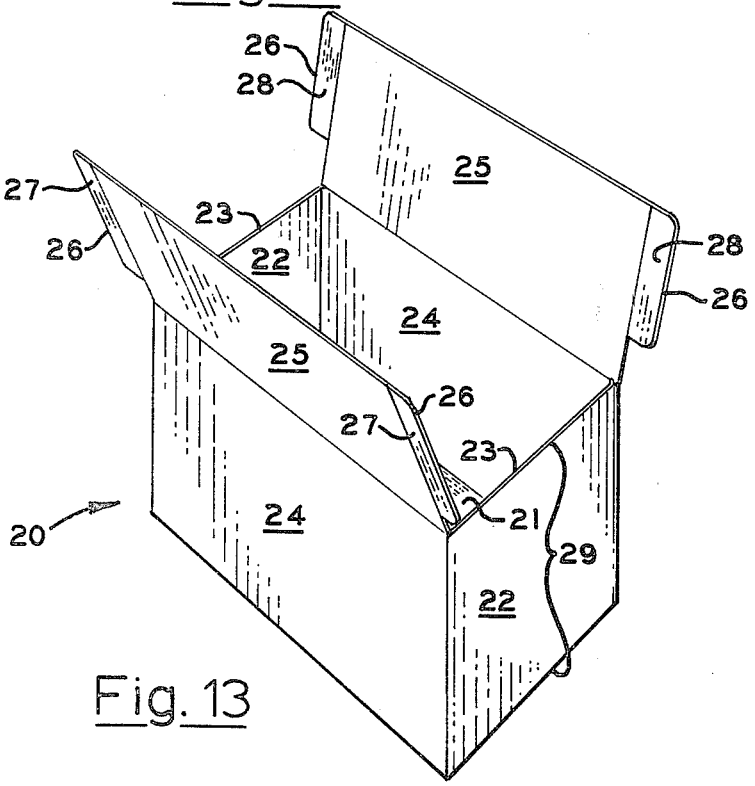
FIG. 13 is a perspective view of a container of a type which can be sealed by the apparatus.

Referring more particularly to FIG. 12, the apparatus 10 has a control system 325. The control system includes control housings 326 which are mounted on the frame 261 of the drive assembly 260. The control housing has a main control switch 327. An electric eye 328 is mounted on the upper channel member 56 at the position shown in FIG. 2. The position of the electric eye is such that it can register when the upper edge 23 of the end panel 22 of a container 20 reaches the elevation at which it is desired that the upper edge be during transport of the container through the apparatus. This elevation is approximately the same as the upper edges of the belts 281 of the compression assembly 275. The electric eye can be of any suitable type such as a modulated light emitting diode infrared electric eye manufactured by Banner Engineering Corporation, 9714 Tenth Avenue, North Minneapolis, Minn. 55441. A control console 329 is mounted on the channel member 56 on the right as viewed in FIG. 3. Referring again to FIG. 12, the control console mounts an on-off switch 330, a stop button or switch 331, a start button or switch 332 and a jog-run selector switch 333. The on-off switch is, of course, open in the "off" position and closed in the "on" position. The stop switch is opened when pressed. The start switch is closed only when pressed. The jog-run switch is open when in the "jog" position and closed when in the "run" position.

The control system 325 has a main electrical supply system 340 of any suitable type interconnecting in series relation the main control switch 327 and the drive motor 263. The control system 325 includes a second electrical system 341. The system 341 includes a transformer 342 wired in receiving relation to the main electrical system. An electrical conductor 343 interconnects the transformer and the on-off switch 330 of the control console 329.

The second electrical system 341 includes an adhesive heating subsystem 344. The heating subsystem 344 has an electrical conductor 345 interconnecting conductor 343 to a pair of thermostats 346 which are individually mounted in controlling relation to the adhesive dispensing units 300. The thermostats are of a conventional design and are employed in controlling the temperature of the adhesive within the units to maintain the adhesive in fluid form. Similarly, a pair of indicator lights 347 are individually mounted on the dispensing units. Electrical conductor 348 is extended from the transformer to light 347 on one of the dispensing units 300. Electrical conductor 349 is extended from that light 347 to the thermostat 346 of that dispensing unit. An electrical conductor 350 is extended from the thermostat 346 of that unit to a heater 351 located in that dispensing unit 300. An electrical conductor 352 operably interconnects the heater 351 and electrical conductor 348. An electrical conductor 353 interconnects conductor 348 and the light 347 of the other dispensing unit 300. An electrical conductor 354 interconnects that light and the thermostat 346 of that unit. Electrical conductor 355 operably interconnects the thermostat 346 and heater 356 of the other dispensing unit. An electrical conductor 357 interconnects the heater 356 and electrical conductor 348.

Figure 11:
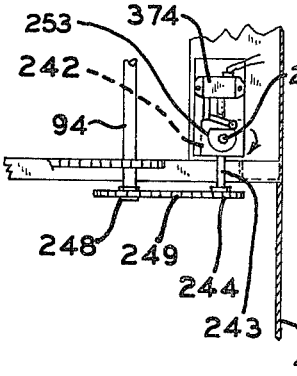
FIG. 11 is a fragmentary, longitudinal vertical section taken on line 11—11 in FIG. 4.
Figure 10:
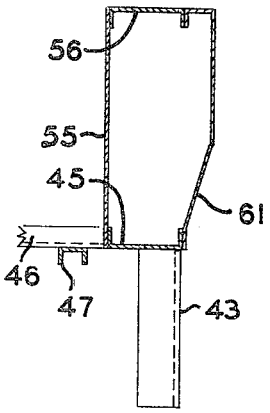
FIG. 10 is a fragmentary transverse section taken from a position indicated by line 10—10 in FIG. 2.

The second electrical system 341 includes a sensing and operating subsystem 370. The subsystem 370 has an electrical conductor 371 which interconnects the transformer 342 and a control relay 372. An electrical conductor 373 interconnects the control relay 372 and the electric eye 328. The subsystem 370 has a microswitch 374 mounted on the apparatus adjacent to the conveyor 84 as shown in FIG. 11 and disposed for periodic operable engagement by the cam wheel 253 of the right angle gearbox 242. An electrical conductor 376 interconnects the on-off switch 330 of the control console 329 and the microswitch 374. An electrical conductor 377 operably interconnects the microswitch and the solenoid 218. An electrical conductor 378 interconnects the solenoid 218 and electrical conductor 371. An electrical conductor 379 operably interconnects the electric eye 328 and conductor 376. Electrical conductor 380 interconnects conductor 376 and the stop switch 331.

The sensing and operating subsystem 370 further includes a normally open switch 385 and a normally closed switch 386. An electrical conductor 387 interconnects conductor 379 and switch 385. Electrical conductor 388 interconnects the switches 385 and 386. Electrical conductor 389 interconnects switch 386 and a control relay 390. An electrical conductor 391 interconnects control relay 390 and conductor 371. An electrical conductor 392 interconnects conductors 377 and 389. Electrical conductor 393 interconnects electric eye 328 and conductor 371. Control relay 390 controls switch 385 and control relay 372 controls switch 386 through conventional connections which are not shown for purposes of illustrative convenience. It will be understood, however, that when control relay 390 is energized, normally open switch 385 is closed by the relay 390. Similarly, when control relay 372 is energized, normally closed switch 386 is opened by the relay 372.

An electrical conductor 400 interconnects the stop switch 331 and the start switch 332. An electrical conductor 401 interconnects the start switch 332 and a motor starter contactor 402. An electrical conductor 403 interconnects contactor 402 and electrical conductor 371. Electrical conductor 404 interconnects conductor 400 and the jog-run switch 333. Electrical conductor 405 interconnects the jog-run switch 333 and a normally open switch 406 which is controlled by motor starter contactor 402. Electrical conductor 407 interconnects switch 406 and conductor 401.

The motor starter contactor 402 is of conventional design and is linked through a circuit, which is not shown for illustrative convenience, to the main electrical supply system 340 and to the switch 406. It will be understood that when contactor 402 is operated by the passage of current through conductor 401 and 403, the contactor operates to complete the supply system 340 to supply current to the electric motor 263 for its operation and to close normally open switch 406. When jog-run switch 333 is in the closed or "run" position, merely pressing and then releasing the start button 332 causes the drive motor 263 to operate continuously until the stop button 331 is pressed. This is due to the motor starter contactor operating instantaneously, upon pressing of the start button, to close switch 406 and complete the circuit through the jog-run switch 333 and around the start button even though the start button 332 is thereafter released. Conversely, when the jog-run switch 333 is in the open or "jog" position, closure of the switch 406 by the contactor 402 when the start button 332 is pressed does not complete the circuit around the start button due to the jog-run switch being open. Consequently, the drive motor 263 is driven in this mode only so long as the start button 332 is pressed.

OPERATION

The operation of the described embodiment of the subject invention is believed to be clearly apparent and is briefly summarized at this point. For purposes of illustrative convenience, the electric eye 328 can be viewed as defining a first or primary path of travel extending longitudinally of the apparatus and horizontally disposed at the elevation of the electric eye. The apparatus operates, as will hereinafter be described, to place the upper edges 23 of each container 20 in this path of travel. The inner runs 98 of the main conveyor assembly 80 can be viewed as defining an associated adjacent path of travel extending longitudinally of the apparatus along the passage 63 adjacent to the first path of travel. The path of travel followed by a container borne by supports 132 as directed by the cam way 214 is referred to herein as the second path of travel. The path of travel followed by a container transported by supports 132 as directed by cam way 251 is referred to herein as the third path of travel.

The apparatus 10 is made capable of operation by closing the main switch 327. The on-off switch 330 is switched to the "on" position to allow electrical current to flow therethrough. The jog-run switch 333 can be placed in either position, but in normal use is placed in the closed "run" position. The start switch 332 is then pushed. As previously noted, closure of the start switch allows current to pass through contactor 402 to initiate operation of the drive motor 263 by completion of the supply system 340 through the contactor and by closure of the switch 406. In this mode, the drive motor 263 drives the conveyors 83 and 84 through the drive assembly 260 to transport the inner runs 98 of the conveyors 83 and 84 from right to left as viewed in FIGS. 1 and 2. Similarly, the drive assembly 260 operates the container positioning mechanism 140, the indexing conveyor assembly 164, the indexing mechanism 180, the adjusting mechanism 210, the discharge conveyor assembly 235, the compression assemblies 275, the top flap folding assembly 290 and the trailing top flap folding assembly 310 all as previously described.

Closure of the main switch 327 also causes current to flow through the adhesive heating subsystem 344. The normally closed thermostats 346 complete the subsystem so that the heaters 351 and 356 are energized to heat the adhesive within the adhesive dispensing units 300. The adhesive thus is made flowable for use as will be described. The thermostats operate in the conventional manner to open when the temperature of the adhesive has been raised to a predetermined level and thereafter to open and close as necessary to maintain the temperature.

Operation of the drive assembly 260 causes the cam wheel 253 periodically to contact and close the microswitch 374. When the microswitch is closed, the solenoid 218 and control relay 390 are energized. When the control relay 390 is energized, it operates to close switch 385, as previously described. Such closure insures that the solenoid 218 remains energized through switch 385 and electrical conductor 392 even though the microswitch 374 opens when released by the cam wheel 253. It will be understood that these same operations take place when the jog-run switch 333 is closed instead of the start switch. However, in this case operation continues only so long as the jog-run switch is held closed. When the solenoid 218 is energized, the shaft 219 thereof is retracted thereby causing the latches 224 to be brought into locking engagement with the shaft 217 to lock the cam ways 214 in the raised position shown in FIG. 5. Thus, the cam ways remain locked in this raised position until the solenoid is deenergized.

Containers 20, having previously been packed with the material such as fruit or other produce to be sealed within their respective containers, are successively delivered to the receiving station 70 of the apparatus 10 by the feed conveyor 12. Each container is oriented as shown in FIG. 5, so that the top flaps 25 extend transversely of the passage 63 with the side flanges 26 thereof extending laterally on opposite sides of the container. The containers successively roll onto the idler wheels 167 of the indexing conveyor assembly 164 and against the belt 170 thereof. The belt, driven from the right angle gearbox 144, picks up each container and carries it thereon into engagement with the stop bar 202, as shown in FIG. 5. The stop bar prevents further movement of the container through the apparatus.

Subsequently, the cam member 183 of the indexing mechanism 180 rotates to trip the lever arm 188 thereby elevating the index conveyor assembly 164, as previously described, and permitting the belt 170 to deliver the container thereon over the stop bar 202 and onto the container supports 142 of the positioning mechanism 140. The feeding wheels 196 and chains 201 rotate to insure that the container moves forward on the supports 142 until it reaches the forward lips 143 which hold the container at that position on the supports.

During continued operation of the apparatus, the conveyors 83 and 84 of the main conveyor assembly 80 then individually transport a pair of corresponding container support assemblies 110 along the inner runs 98 of the conveyors 83 and 84 from right to left as viewed in FIG. 5. The corresponding assemblies 110 face each other and are aligned transversely of the apparatus. The receiving rollers 116 of the corresponding support assemblies roll upwardly along their respective cam ways 214. This exerts upward pressure on the slide assemblies 114 thereof sufficient to carry the assemblies upwardly along the vertical plates 111. Thus, the supports 132 of the slide assemblies are carried on opposite sides of the container supports 142 to contact the bottom panel 21 of the container and lift the container from the container supports 142. The container is thus suspended on and between the supports 132 during further movement through the apparatus. Under the direction of the cam ways 214, the container is carried along the second path of travel which is coextensive with the inner runs 98 of the conveyors, but which rises parallel to the cam ways 214.

The container 20 is lifted along the second path of travel until the upper edges 23 of the container pass in front of the electric eye 328. This instantaneously activates the electric eye to operate control relay 372. Control relay 372 opens normally closed switch 386 which terminates the flow of current both through solenoid 218 and control relay 390. The solenoid 218 is thus de-energized so that the latches 224 are released from shaft 217, as previously described. The weight of the container supported on the supports 132 of the slide assemblies and the resistance of the slide assemblies to movement causes the arm 213 to be pivoted downwardly under tension of the spring 226 as the rollers 116 are rolled along the cam way 214 thereof. Thus, further upward movement of the container is terminated and the container is simply passed through the apparatus at the elevation which has been reached. Each container is thus automatically and rapidly positioned in the apparatus so that the upper edges 23 of each container are disposed at the same elevation within the first path of travel of the apparatus regardless of the height of the container. As a result, containers of varying heights can randomly be fed into the apparatus without concern for their respective heights and without monitoring or adjustment of the apparatus by an operator.

When the slide assemblies 110 bearing a particular container 20 pass beyond the cam way 214 during continued movement of the conveyors 83 and 84, the spring 226 returns the arms 213 and thus the cam ways 214 to the raised positions shown in full lines in FIG. 5 for use in positioning the next successive container. As previously noted, when current flow through the solenoid is terminated, flow through control relay 390 is also terminated. This results in switch 385 returning to its normally open configuration which it retains until the microswitch 374 is again closed as previously described. Thus, one cycle is completed and the operation begins again with the next successive container.

Once positioned on a pair of corresponding support assemblies 110, each container 20 is transported through the apparatus 10 along the passage 63 on the supports 132 thereof so that the upper edges 23 are carried in the first path of travel. As previously described, the top flap folding assembly 290 and trailing top flap folding assembly 310 operate cooperatively to fold the top flaps 25 of the container toward each other prior to introduction into the entrance end portion 293 of the folding assembly 290. This positions the side flanges 26 of the top flaps 25 in laterally extending relation. The flanges 26 pass over their respective guide plates 304 and between the nozzles 301 and metering wheels 302 of their respective dispensing units 300. The metering wheels are driven by the flanges to operate the dispensing units to discharge adhesive through the nozzles onto the lower surfaces 28 of the side flanges 26. The folding rods 303 fold the flanges downwardly for adhesive engagement with their respective end panels 22 of the container. The folding rods also serve to introduce the flanges into the entrance 282 of the compression assemblies 275. As can best be seen in FIG. 1, the belts 281 are transported at the speed of the container so that no frictional contact is applied to the flanges which might pull the flanges away from the end panels. Thus, the flanges are held firmly in engagement with their end panels during movement through the compression assemblies 275.

When the discharge rollers 117 of the slide assemblies 114 bearing an individual container 20 contact the cam ways 251 of the cam plates 250, the slide assemblies 114 are forced downwardly along the third path of the travel. Such travel is continued until the discharge rollers 117 reach the bottom of the cam ways 251. The distance of downward movement is such that the container is deposited on the discharge conveyor assembly 235 and transported thereafter along the upper runs 240 of the chains 239 and discharged from the apparatus through passage 60 onto the discharge conveyor 13. When the discharge rollers 117 reach the bottoms of the cam ways 251, the supports 132 are properly vertically positioned on their respective support assemblies 110 for again receiving a container from the supports 142.

The container support assemblies 110 are then transported along the outer runs 99 of their respective conveyors 83 and 84 toward the forward end 40 of the apparatus to begin the cycle again. As can be seen in the drawings, the support assemblies 110 borne by the conveyors 83 and 84 are spaced from each other so that each container arriving on the supports 142 of the container positioning mechanism is picked up by a pair of supports 132. Similarly, the gear ratios and timing of the various operative components heretofore described is such that the work operations performed thereby are performed at the proper time on each container during passage through the apparatus. The slide assemblies 114 are adjustable by adjustment of the lock nuts 129 to increase or decrease the maximum weight of container which can be borne thereby without sliding downwardly on their respective vertical plates 111. Thus, the apparatus can handle containers of a range of weights up to the preselected maximum.

Therefore, the apparatus of the present invention operates to handle containers of varying dimensions and weights which are randomly conveyed therethrough adjusting rapidly and automatically thereto and positioning the portion of the container on which the work operation is to be performed at the desired elevation in the apparatus for subsequent handling. This is achieved in an apparatus which requires no manual adjustment or monitoring of the operative components of the apparatus to insure a fully dependable and efficient operation.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. In a machine for performing a work operation on successive work objects during passage of corresponding portions of the work objects along a first path of travel, an apparatus for successively positioning the work objects in the machine with said portions thereof disposed in the first path of travel, the apparatus comprising a plurality of supports adapted to receive the work objects with said portions thereof spaced from their respective supports; means mounting said supports for movement from a position, spaced from the first path of travel sufficient to space said portions of the work objects received thereon from the first path of travel, along a second path of travel approaching the first path of travel; and means for individually detecting when said portions of the work objects are disposed in the first path of travel and thereupon terminating movement of their respective supports along the second path of travel.

2. The apparatus of claim 1 wherein the mounting means is a conveyor assembly having a run thereof disposed in feeding relation to the first path of travel of the machine and said supports are mounted on the conveyor assembly for individual movement transversely of the run along the second path of travel approaching the first path of travel.

3. The apparatus of claim 2 including cam means mounted on the apparatus for directing said supports along the second path of travel transversely of said run and wherein said detecting means individually deactivates the cam means for each support upon detecting when said portion of the work object received on that support is disposed in the first path of travel.

4. An apparatus for transporting work objects along a primary path of travel comprising a conveyor assembly having a run with portions extending along the primary path of travel and members extending transversely of said run of the conveyor assembly; means for moving said run of the conveyor assembly in a conveying direction to move said portions of the run along the primary path of travel; supports individually slidably mounted on the members and adapted to receive work objects; means for gradually sliding each support along its respective member toward the primary path of travel during said moving in the conveying direction; and control means for detecting when a predetermined portion of each work object reaches the primary path of travel and thereupon operating said sliding means to stop sliding of the support of that work object along its respective member.

5. The apparatus of claim 4 including second sliding means borne by the apparatus for sliding each of said supports on its respective member to a position remote from the primary path of travel prior to that support reaching the first sliding means.

6. The apparatus of claim 4 wherein the sliding means has a cam way engageable by the suppports to cause said gradual sliding during said moving of the run of the conveyor assembly and individually collapsible from said supports by the control means upon detecting when the predetermined portions of the work objects borne by said supports reach the primary path of travel.

7. The apparatus of claim 6 wherein the cam way of the sliding means is defined by an arm assembly borne by the apparatus for movement to and from a cam position and the control means has a latch mechanism engageable with the arm assembly to retain it in said cam position and operable by the control means to release the arm assembly for movement from the cam position upon said detecting by the control means.

8. The apparatus of claim 6 wherein said supports are borne by their respective members by frictional engagement therewith sufficient to prevent gravitational displacement of the supports and work objects borne thereby from a given position while being slidably postionable on their respective members by engagement with the cam way.

9. An apparatus for positioning corresponding portions of containers in a first path of travel for transport through a container handling machine, the apparatus comprising a plurality of supports adapted to receive containers with said portions spaced from their respective supports; means mounting the supports in spaced relation to the first path of travel for movement along a second path of travel approaching the first path of travel; and control means for individually detecting when said portions of the containers reach the first path of travel and thereupon terminating movement of their respective supports along the second path of travel.

10. The apparatus of claim 9 wherein the mounting means is a conveyor assembly operable to transport a run thereof along a path associated with the first path of travel and individually mounting said supports for movement transversely of the conveyor assembly and including cam means operable individually to direct the supports along the second path of travel during movement of said run along the associated path.

11. The apparatus of claim 10 wherein the conveyor assembly has a plurality of guides extending substantially transversely of said associated path and individually mounting one of said supports restrained against movement therealong in said second path of travel by a force less than a preselected minimum and said cam means is positioned for successive engagement by the supports during movement of the conveyor assembly in said associated path to apply force to the supports reaching the preselected minimum.

12. The apparatus of claim 11 wherein the control means includes a system operable upon said individually detecting when the portion of a container borne by a support has reached the first path of travel to reduce the force which can be applied by the cam to that support to less than said preselected minimum whereupon movement by that support along the second path of travel is terminated and the support thereupon moves with the conveyor assembly in the associated path carrying said portion of the container borne thereby in the first path of travel.

13. The apparatus of claim 9 wherein the mounting means is a conveyor assembly operable to transport a run thereof along a path of travel adjacent to said first path of travel and extending through the container handling machine to a container discharge station and said conveyor assembly carries the supports along the adjacent path subsequent to termination of said movement of the supports along the second path of travel.

14. The apparatus of claim 13 including an assembly mounted in the discharge station for receiving containers in the adjacent path and means in the container discharge station for individually successively directing the supports along a third path of travel from the first path of travel to deposit the containers on said assembly.

15. The apparatus of claim 14 wherein the control means includes a collapsible cam way disposed for successive engagement by the supports and a solenoid operable to retain said cam way in an extended condition for direction of the supports along the second path of travel until said detection of the portion of a container reaching the first path of travel and then to release said cam way to permit movement of said portion with the conveyor assembly in the first path of travel.

16. An apparatus for handling containers of random heights comprising a pair of opposed conveyors powered for movement about substantially vertical axes of rotation to carry corresponding runs thereof in spaced substantially parallel relation from a container receiving station through a work station to a container discharge station; means for successively delivering containers to the receiving station oriented to present an upper portion thereof in upright relation; means for successively receiving said containers in the discharge station; a plurality of guide plates borne by the conveyors arranged in corresponding pairs individually mounted on the conveyors in alignment transversely of the runs and disposed in substantially vertical attitudes; container supports; clamp assemblies mounting the supports on individual guide plates for movement therealong against predetermined resistance between predetermined lowered and raised positions; a cam way successively engageable in the receiving station to overcome said predetermined resistance to move the supports of said corresponding pairs of guide plates upwardly through the receiving station to pick up one of the containers on said supports in movement toward the raised positions; and control means for detecting when said upper portion of the container has reached a predetermined elevated position and for thereupon releasing said cam way relative to said supports of what container to terminate further movement of the supports toward the raised position.

17. The apparatus of claim 16 wherein a second cam way is secured on the apparatus in the discharge station for engagement to overcome said predetermined resistance of supports of successive corresponding pairs of guide plates to move said support downwardly toward their lowered positions and through the discharge station to deposit the containers borne thereby on the receiving means.

18. The apparatus of claim 17 wherein each of said clamp assemblies mounts a pressure plate frictionally engaging its respective guide plate and adjustable thereagainst to increase and alternatively decrease said predetermined resistance.

19. The apparatus of claim 18 wherein the pressure plate mounts a sintered bronze slide pad impregnated with lubricant to permit adjustment of said resistance while facilitating movement when said resistance is overcome.

20. The apparatus of claim 16 wherein a latch mechanism and spring retain said cam way in an elevated position and the control means includes a solenoid operable upon said detecting to operate the latch to release the cam way for movement from the elevated position under the predetermined resistance of the clamp assemblies to preclude further upward movement of the supports and returnable by said spring to the elevated position subsequent to movement from the cam way by said supports.

21. The apparatus of claim 16 including means borne by the apparatus for sealing said upper portions of the containers in the work station and having belts urged against said portions of the containers for sealing thereof and movable in corresponding runs transported along paths of travel toward the discharge station at substantially the speed of the corresponding runs of the conveyors.

* * * * *

UNITED STATES PATENT AND TRADEMARK OFFICE

CERTIFICATE OF CORRECTION

PATENT NO. : 4,170,095

DATED : October 9, 1979

INVENTOR(S) : James R. Hightower

It is certified that error appears in the above-identified patent and that said Letters Patent are hereby corrected as shown below:

Column 3, Line 34, before "25", delete "flapes" and insert ---flaps---.

Column 5, Line 16, between "member" and "plate" insert ---or---.

Column 20, Line 12, after "of" and before "container", delete "what" and insert ---that---.

Signed and Sealed this

*Eighteenth* Day of *December 1979*

[SEAL]

*Attest:*

SIDNEY A. DIAMOND

*Attesting Officer*

*Commissioner of Patents and Trademarks*